United States Patent [19]

Tegart

[11] Patent Number: 4,572,512

[45] Date of Patent: Feb. 25, 1986

[54] GOLF COURSE

[76] Inventor: Harold G. Tegart, 9147 Foothill Blvd., Sunland, Calif. 91040

[21] Appl. No.: 431,567

[22] Filed: Sep. 30, 1982

[51] Int. Cl.[4] ..... A63B 69/36; A63B 67/02

[52] U.S. Cl. ..... 273/176 A; 273/186 R; 273/181 R; 273/DIG. 28

[58] Field of Search ... 273/176 A, 186 RA, DIG. 28, 273/185 A, 176 AA, 176 AB, 176 E, 176 F, 176 FA, 176 FB, 176 L, 176 R, 181 A

[56] References Cited

U.S. PATENT DOCUMENTS

| | | | |
|---|---|---|---|
| 1,851,423 | 3/1932 | Ely | 273/176 A |
| 2,003,074 | 5/1935 | Gage | 273/176 A |
| 2,248,053 | 7/1941 | Bales | 273/176 A |
| 3,129,943 | 4/1964 | McKee | 273/176 A |
| 3,216,726 | 11/1965 | Andersen et al. | 273/DIG. 28 |
| 3,310,310 | 3/1967 | McKee | 273/176 A |
| 3,314,679 | 4/1967 | Kolln | 273/176 A |
| 3,464,703 | 9/1969 | Vallas | 273/176 A |
| 3,685,832 | 8/1972 | Johnson | 273/176 A |
| 3,820,133 | 6/1974 | Adorney et al. | 273/186 |
| 3,904,209 | 9/1975 | Thomas | 273/176 A |
| 3,999,764 | 12/1976 | Nitsche | 273/176 A X |
| 4,019,748 | 4/1977 | Healey | 273/176 A X |
| 4,063,738 | 12/1977 | Michalson | 273/176 A |
| 4,129,300 | 12/1978 | Magnuson | 273/176 A |
| 4,192,510 | 3/1980 | Miller | 273/176 A |
| 4,283,056 | 8/1981 | Miller | 273/176 A |

*Primary Examiner*—George J. Marlo
*Attorney, Agent, or Firm*—John E. Wagner

[57] ABSTRACT

A compact golf course which employs a number of tee positions facing a series of targets at ranges up to 300 yards with distance indicators whereby a player at one of the tees can drive tee and fairway shots recording precisely the distance attained one each shot. Chipping greens are provided. Putting greens are provided for the putting phase of the golf game. The golfer moves in sequence from the tee and fairway target range to the chipping range and the putting greens. Score cards are provided and layouts of famous course appear on charts located at each tee position to allow the player to play in sequence the holes of the selected famous course. Television cameras are located in the tee and fairway driving range portion of the course. A television monitor and a camera selector switch are located at each tee position so that the golfer may select a particular camera scene to be viewed on the television monitor. Player actuated supplemental lighting is provided. An improved method of scoring provides a permanent record of distance and efficiency of each golf shot in progress, not just the number of strokes per hole as in conventional golf.

9 Claims, 8 Drawing Figures

THE CHIPPING AND PITCHING APEA, PPO-SHOP AND CLUB HOUSE LOCATED AT ADJACENT SELECTED APEA.

GOLF COURSE

BACKGROUND OF THE INVENTION

With the overcrowded conditions of conventional golf courses, the expense of play and the time required to play a round of golf, a number of people have recognized the need for providing a compact form of golf course which is less expensive due to use of less land, allows multiple players to speed up the time and as a result of the two, reduces the cost to the golf player. A number of patents have issued on compact golf courses as a result. These patents include the following:

| U.S. Pat. No. | Inventor | Issued |
|---|---|---|
| 3,129,943 | McKee | April 21, 1964 |
| 3,310,310 | McKee | March 21, 1967 |
| 3,464,703 | Vallas | September 2, 1969 |
| 3,685,832 | Johnson | August 22, 1972 |
| 3,904,209 | Thomas | September 9, 1975 |
| 3,999,764 | Nitsche | December 28, 1976 |
| 4,019,748 | Healey | April 26, 1977 |
| 4,063,738 | Michalson | December 20, 1977 |
| 4,129,300 | Magnusoa | December 12, 1978 |
| 4,192,510 | Miller | March 11, 1980 |
| 4,283,056 | Miller | August 11, 1981 |

Each of these patents disclose golf courses requiring significantly less ground than a standard golf course and often to varying degrees appear to achieve the objective of faster play and reduced cost.

It would appear from the study of these patents, many of them go to great extent to simulate play on the golf course and many attempt to provide an atmosphere of isolation through the use of natural and artificial barriers between player tees providing a degree of simulation of play of a conventional golf course. While a number of these objectives have been attained at least partially, the compact golf course has not reached any significant degree of acceptance in the golf community as noted by their significant absence from the modern day golf scene. In a typical metropolitan area, one will find public and private full size golf courses, par three or reduced yardage golf courses and driving ranges but this inventor has yet to see a single operating compact golf course of the type disclosed in the above patents. Recognizing the continuing need for compact golf courses and after further study of the features of the several disclosures, this inventor finds that his basic concept provides features not present in any prior compact golf course designs and in fact provides a game of golf which is superior in a number of respects to the conventional golf game.

BRIEF DESCRIPTION OF THE INVENTION this inventor has, he believes, eliminated some of the inherent weaknesses in the prior attempts to attain a satisfactory compact golf course and to provide a more interesting play than even conventional golf. He employs a generally rectangular course of variable dimensions and having as a typical size 100 yards in width by 400 yards in length exclusive of service, club house and parking areas. The layout is generally rectangular which makes it most adaptable to available real estate but is not limited to such a shape. The layout includes a number, for example 10 tees, each directed toward a fairway of at least 300 yards in length and 100 yards in width. A number of yardage indicators which may be in the form of yard lines are provided as well as targets at varying ranges from 40 to 300 yards. The targets may take the form of simulated green and pin. Hazards on the fairway are provided and an out of bound line on each side of the fairway are present. Within short walking distance of the tees are a plurality of pitching greens with arcuate lines defining varying distances from the pitching green, namely 50 to 20 yards. One or more putting greens are also provided. A number of television cameras are directed at the fairway allowing the player to follow and locate his ball in flight and on landing in order to properly record its range. A television receiver is located for viewing by players in observing their balls. For night play, in addition to overall lighting, enhanced lighting to aid television detection of the balls in light is illuminated responsive to players golf swings.

An improved water hazard is also disclosed as well as an improved tee station.

In accordance with the method of this invention, the player is given a number of distinctive balls sufficient for a round of 9 or 18 holes. He selects a particular course which he intends to simulate playing and records the yardage for each of the holes of the round on a score card. A player drives his first tee shot and records the distance attained and any penalty if he enters a trap or lands out of bounds. He subtracts the yardage attained from the yardage remaining on the first hole of his selected course and takes his second or fairway shot and again subtracts yardage attained from the remaining yardage to the first hole. When he reaches 50 yards or less in the first hole, he moves to the chipping green at the appropriate distance on the arcuate play areas and chips to the green by recording each shot numberically. If he lands on the target green in his fairway play, he moves to the putting green to putt out and records his play for the hole. He and his playing partners return to their tee, reserved to them, and proceed to play the next hole in like manner. The play may be by a foursome, threesome, pair or single player without affecting performance. The score card reflects not only the number of strokes required for each first hole but also the yardage and quality of shot obtained for each fairway club used and his number of putts. Alternate embodiments involve a double ended course and a trapazoidal shaped course.

BRIEF DESCRIPTION OF THE DRAWING

This invention may be more clearly understood from the following detailed description and by reference to the drawing in which.

DETAILED DESCRIPTION OF THE INVENTION

Figure 1:
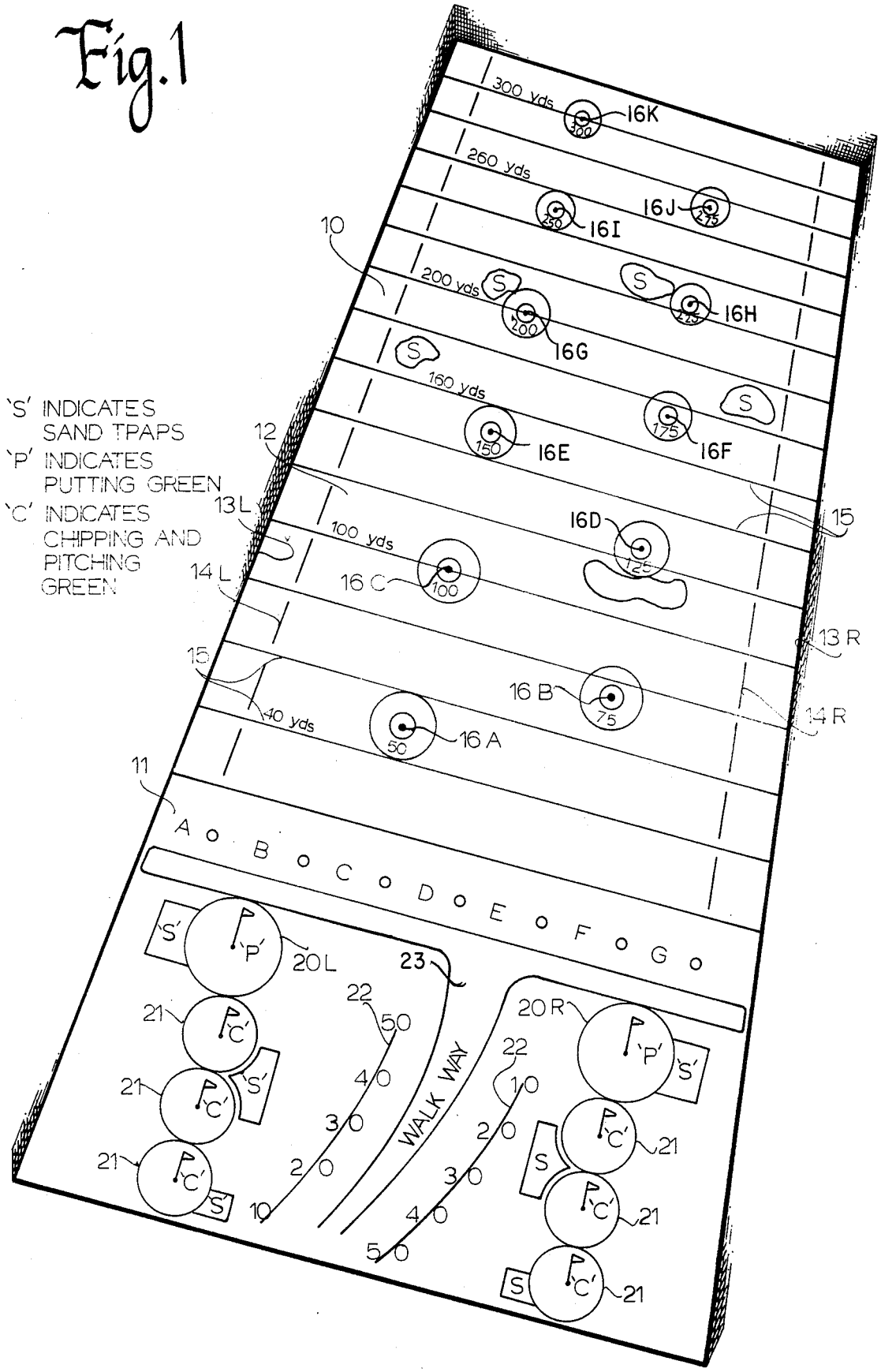
FIG. 1 is a perspective view of a compact golf course in accordance with this invention.

Now for a clear understanding of this invention, attention is direct toward FIG. 1 which provides somewhat of an aerial view of the basic elements of this invention excluding club house, service area and parking. The compact golf course in accordance with this invention generally designated 10, comprises a tee area 11 including a number of individual tee's designated A–G for convenience. The tees face a fairway generally designated 12 including perimeter fences denoted by lines 13L and 13R and out of bound lines 14L and 14R. We have a number of yardage indicators shown for convenience as yardage lines 15, preferably located at 20 yard intervals from the tees 11. Also present in the fairway are a plurality of targets 16A through 16K. The targets are shown 11 in number, however there is nothing critical about the particular number or location of the targets other than that they are at varying distances from the tees in the fairway. A number of sand traps designated S and one or more water hazards designated W are present in the fairway to provide natural hazards in play. The rough strip designated in FIGS. 2A and 3 as ROUGH region is preferably mowed at a higher level than the fairway to accurately represent rough.

In FIG. 1 shown adjacent to the tees 11 but located at any place in the region are a pair of putting greens 20L and 20R designated by the letters P and a number of chipping greens 21 designated by the letter C. The chipping greens 21 are preferably located at the side perimeter of the property of the course and between the chipping greens 21 to the left and 21 to the right in FIG. 1 is a central walkway 23 from the tee area along a curved arc and a number of chipping positions 22 at varying distances from the several, for example, 6 chipping greens 21. The curved chipping lines 22 allow the players to position themselves at any correct distance from the chipping pin corresponding to the remaining distance after his last fairway shot. If his remaining distance was about 43 yards he positions himself along the left chipping line 22 slightly closer to the 40 indicator than the 50 yard mark. The large number of chipping greens and the continuously variable chipping distances allows a number of players to chip simultaneously without interference with each other. Adjacent to the chipping greens 21 are the putting greens 20L and 20R, either of which the player may use. As shown in FIG. 1, the putting greens are located near the tees 11 as is usually found in conventional full courses but the location of the greens may be moved to accommodate the particular terrain in which the course is located.

Figure 2:
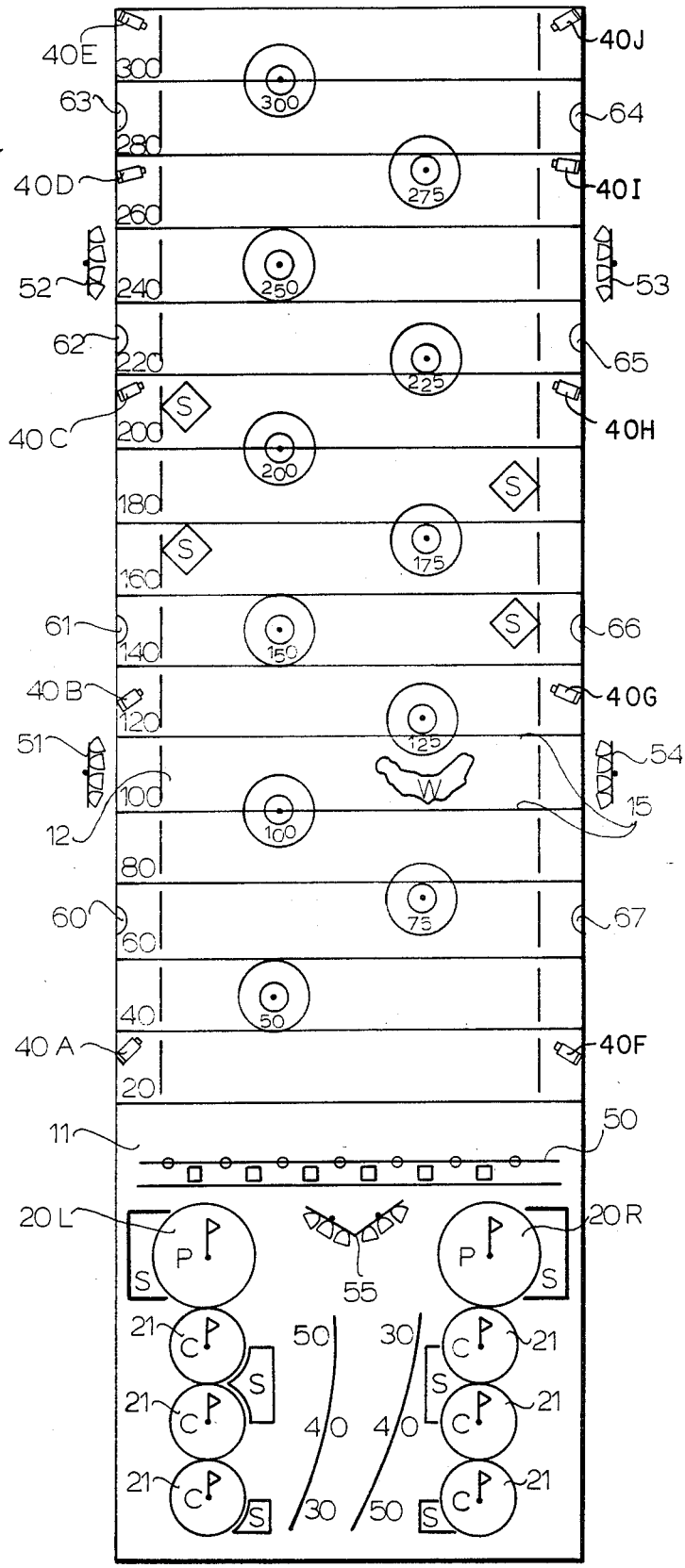
FIG. 2 is a plan view thereof.
Figure 2A:
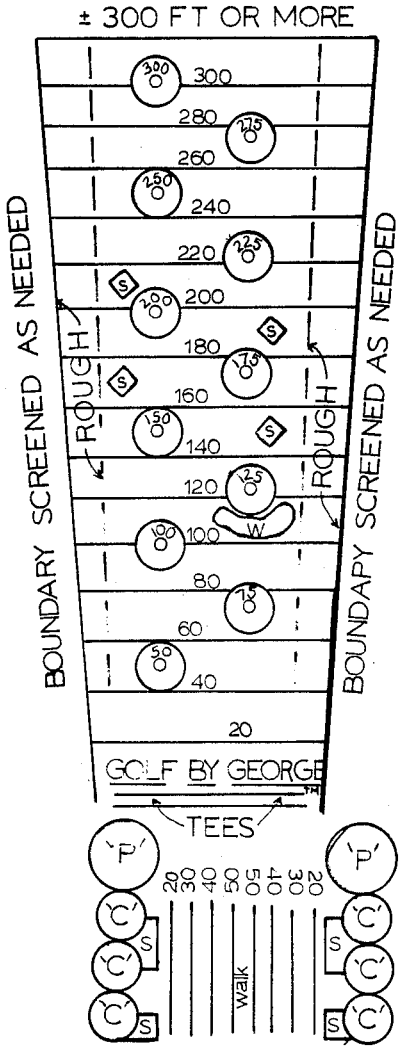
FIG. 2A is a plan view of an alternate trapezoidal embodiment of this invention.

Now referring to FIG. 2, two other aspects of this invention may be seen. In addition to the tees 11, yardage lines 15, greens 20 and 21, the fairway targets 16 A–K may be seen more clearly. They each include a pin or flag and are located at 25 yard range intervals from the tee line 11. The target greens 16 are 20 yards in diameter and include an outer circle of 10 yards radius and an inner circle of 3 yards.

Certain other features of this invention may also be seen in FIG. 2. A number of television cameras 40 are located at the side of the fairway 12 with suitable protection from stray balls and directed toward the fairway 12. The cameras 40 cover the fairway region so that any one camera will be no greater than 60 yards from any ball lie. The cameras 40 aid the player in picking out his ball and in accurately determining the distance of each shot. Of course, he may do this by eye but the television cameras give him a closer view. The cameras may have zoom capability and in such case where controls are available to the player, he may have a quite close look at his ball. Since it is the practice of using distinctively marked balls for each player, the identification of a player's ball is even easier with the television cameras. As shown in FIG. 2, a total of 10 television cameras are used but this number may vary depending upon the requirements of the particular course.

Figure 6:
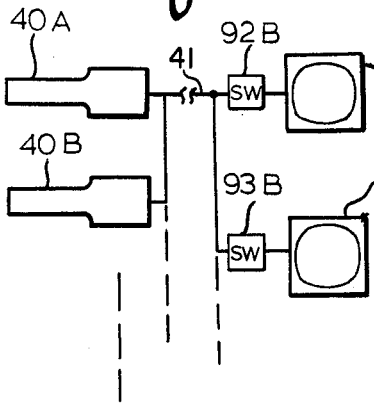
FIG. 6 is a simplified block diagram of the television system of this invention.

FIG. 6 shows a simplified block diagram of the television camera and monitor system. The several cameras 40 are all connected by cables 41 to each of the tees. A selector switch 92B, 93B etc. allows players to connect any of the cameras to the local monitor 92 of FIG. 4.

Figure 4:
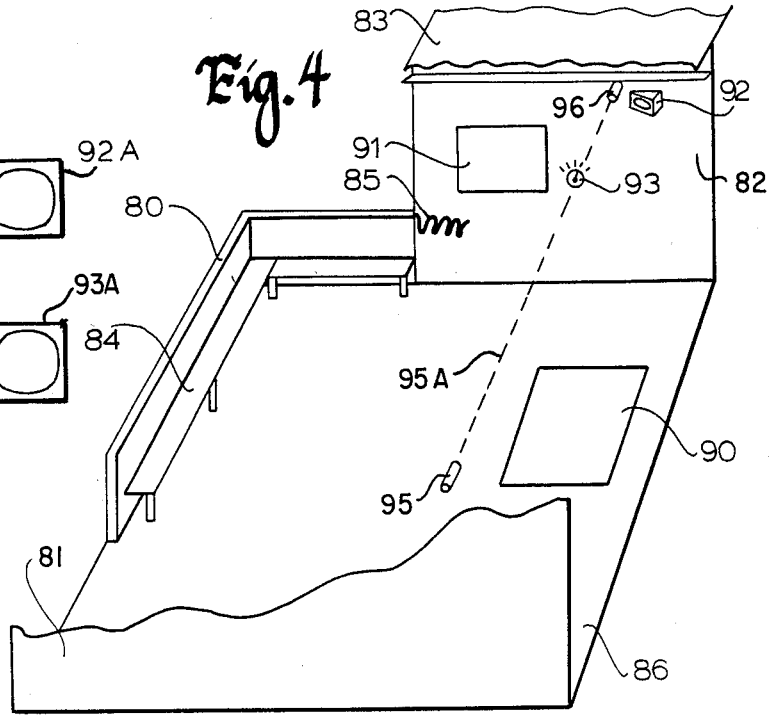
FIG. 4 is a fragmentary perspective view of a single tee.
Figure 5:
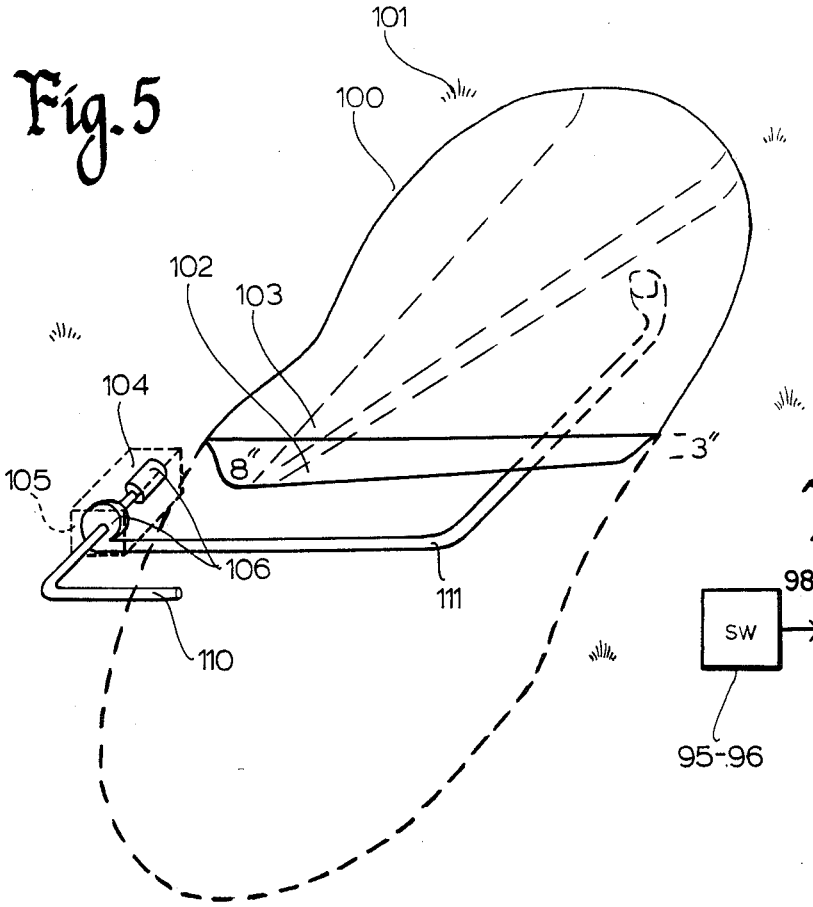
FIG. 5 is a sectioned perspective view of a novel water hazard in accordance with this invention.
Figure 7:
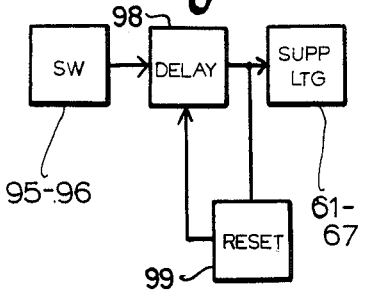
FIG. 7 is a simplified block diagram of the supplemental lighting visual aid system of this invention.

FIG. 2 also shows a basic lighting system used for night play and a supplemental play actuated visual aid lighting system is shown in FIGS. 4 and 7. The basic lighting system includes drop or fluorescent lighting at each tee designated 50 and banks of elevated flood lights 51–54 directed at the fairway 12 and 55 directed at the chipping and putting greens.

In addition to this basic lighting, a number, for example, 8 lights 60–67 are located immediately beside the fairway 12 and are actuated by play to enhance the lighting whenever a ball is driven to aid its location. The overall average lighting can thereby by reduced and yet better visibility is available when needed.

The lights 60–67 provide the supplemental lighting under the control of the players as is described below.

Figure 3:
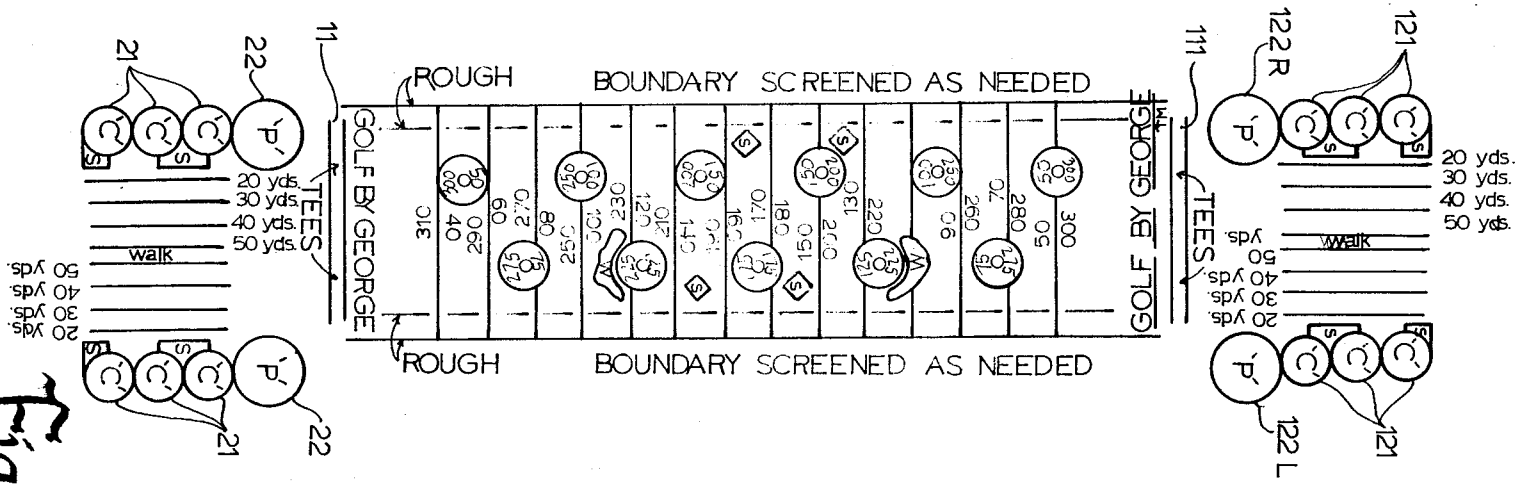
FIG. 3 is an alternate embodiment double ended layout of this invention.

FIG. 3 shows an alternate embodiment of this invention which is double-ended. In FIG. 3 the same or slightly longer fairway 12 is used than in the case of FIG. 1. This embodiment differs in that an additional set of tees 111, chipping greens 121 and putting greens 122 are present at the opposite end of fairway 12. The fairway range markers 15 bear designations indicating the distance from either end, usually visible from one end only. The targets 16 also bear dual distance designations to be observed by the golfer at the tees and by the cameras.

This version of my invention, requiring only about 20 percent additional real estate increase the number of tees by 100 percent. Each of the other features of this invention remain in the embodiment of FIG. 3.

Referring now to FIG. 4, one form of tee may be seen in the form of a booth generally designated 80 including boundary side walls 81 and 82 which form common walls with adjoining tee booths. The booths 80 are preferably covered by a roof 83 for sun and rain protection for the players. A bench 84 is provided for other members of the player's party and a rack 85 for golf bags may be present. The front of the booth 80 includes some form of turf 86, either natural or artificial for fairway shots. It also receives golf tees for tee shots. A central tee region 90 similar to driving ranges may be provided or the entire front area may be of turf.

The booth 80 also includes a course layout board 91, preferably attached to the wall 82 and having a number of large layouts for prominent courses of the world. The players may select the course to be played and display the appropriate layout on the wall throughout play. Where such courses will include dog-leg fairways and unusual hazards, the precision needed to play such courses is simulated in this invention by the targets 16 toward which all tee and fairway shots should be directed. Thus the presence of targets on the fairway adds a new dimension to the game of golf by providing a He then proceeds to the Chipping-Pitching Greens 'C' approach area.

He places either his own, or a specially marked ball in the adjacent 'C' approach area on one of the 2 sets of 'Yardage Lines' at the location along the line that corresponds with the distance he missed his target green. He then chips or pitches on to the 'C' green and putts out.

If he has reached the fairway target green he notes on his scorecard only the observed distance in yards that the ball is from the pin.

He then proceeds to the 'P' Putting Green, places either his own ball, or specially marked course ball, at that noted yardage or 3 foot strides from a hole on the 'P' Putting Green, putts out and records his total strokes for that hole on is scorecard.

He then walks back to the tee reserved for him, and plays the remaining holes in like manner.

All lengths of distance are measured in yards, or 3-foot strikes.

If, during fairway play, he lands in a fairway sand trap, he marks 'S' on his scorecard next to the noted stroked distance when he went into the trap. He continues his fairway play as though he had not gone into the trap. However, after he has reached within 50 yards of his fairway Target Green, but missed it, he proceeds to the Chipping-Pitching Greens, places his or her special ball at his last remaining yardage from the Chipping-Pitching Green pin. He must then chip or pitch into the trap that is adjacent to the Chipping-Pitching Green 'C', play from the trap onto the Chipping-Pitching Green 'C' and putt out.

If he has an 'S' during his fairway play, and does not miss his Target Green, he must first toss his ball into the sand trap adjacent to the Putting Green 'P' and play out onto the Putting Green 'P', and putt out, recording his total strokes or that hole.

If he misses his 'Target Green' and lands in the adjacent sand trap, then at the putting green 'P' he must first toss his ball into the sand trap at 'S' and play out onto the putting green 'P' and putt out.

When golfer's ball lands in the rough, he plays his next ball at his tee off of the rough pad.

If the ball lands in a water trap, he marks a small "w" on his scorecard next to noted stroked distance and count one stroke penalty.

When ball hits side boundary, he marks a small "b" on his scorecard next to the noted stroked distance for that hole, and he takes a stroke penalty.

Following this procedure, the full round of golf proceeds for each player.

The above described embodiments of this invention are merely descriptive of its principles and are not to be considered limiting. The scope of this invention instead shall be determined from the scope of the following claims, including their equivalents.

I claim:

1. A compact golf course comprising;
- a layout including a fairway region;
- a plurality of tee areas directed toward said fairway region for use by players at said plurality of tees;
- a plurality of range markers on the fairway to denote distance driven from the tees;
- a plurality of targets on said fairway region at varying distances from said tees to act as targets in tee and fairway shots;
- a plurality of hazards on said fairway;
- at least one chipping green for completing fairway play by chipping to a green;
- a plurality of range markers spaced from the chipping green for the player to place his ball the remaining distance from the green equal to his closest distance from his last fairway shot to the appropriate target; and
- at least one putting green including a cup for putting after reaching the green;
- a plurality of television cameras directed at different portion of said fairway;
- a television monitor in communication with said television cameras and located at at least one of said tee areas and visible by the players using said tee area for monitoring the distance and flight of balls driven from the tee area and a selector switch at said at least one tee for selecting the television camera scene to be displayed on said monitor.

2. The combination in accordance with claim 1 wherein said fairway includes a maximum range and range markers of up to approximately 300 yards from the tees to accomodiate the longest practical tee shot and targets ranging from in the order of 40 to 300 yards from the tees whereby a target green is available for practically any fairway shot to be matched to a course selected.

3. The combination in accordance with claim 1 including a television monitor at each of a plurality of tees and a selector switch at each of said tees for selecting the television camera scene to be displayed on the monitor at that tee.

4. The combination in accordance with claim 1 including lighting means for said fairway and means responsive to the golfer's swing for energizing said lighting means.

5. The combination in accordance with claim 4 wherein said means responsive to the golfer's swing comprises a light source and photocell combination positioned whereby the swing of the golf club intercepts the light beam from the light source to the photocell to trigger the application of power to said lighting means.

6. The combination in accordance with claim 5 wherein said light source and photocell combination are positioned above the head of the player whereby the light beam there between is interrupted during the upper portions of the golfer's swing.

7. The combination in accordance with claim 6 including delay means for delaying the energizing of said lighting means after interruption of the light beam whereby the light triggering signal is detected by the golfer's back swing and energization of the lighting means occurs after completion of the golfer's stroke.

8. The combination in accordance with claim 1 wherein said fairway region is generally rectangular in shape and includes out-of-bounds along each side thereof.

9. The combination in accordance with claim 1 in which at least one of said hazards comprises a water area of depth ranging from about 3 inches to 8 inches and of hard surface bottom whereby balls may be easily retreived there from and may strike the water hazard with such force and direction as to bounce therethrough.

* * * * *

UNITED STATES PATENT AND TRADEMARK OFFICE

CERTIFICATE OF CORRECTION

PATENT NO. : 4,572,512

DATED : Feb. 25, 1986

INVENTOR(S) : Harold G. Tegart

It is certified that error appears in the above-identified patent and that said Letters Patent is hereby corrected as shown below:

Abstract:

Line 5, after "attained", cancel "one" and insert -- on --;

Line 10, after "famous", cancel "course" and insert -- courses --;

Column 2, line 34, after "shot", cancel"numberically" and insert -- numerically --.

Signed and Sealed this

*Fifteenth* Day of *July 1986*

[SEAL]

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,572,512

DATED : February 25, 1986

INVENTOR(S) : Harold G. Tegart

It is certified that error appears in the above-identified patent and that said Letters Patent is hereby corrected as shown below:

Abstract:

Line 5, after "attained", cancel "one" and insert ---on---;

Column 2, line 34, after "shot", cancel "numberically" and insert ---numerically---.

Signed and Sealed this

Eighteenth Day of November, 1986

*Attest:*

DONALD J. QUIGG

*Attesting Officer* *Commissioner of Patents and Trademarks*